US010924846B2

(12) United States Patent
Wolff et al.

(10) Patent No.: US 10,924,846 B2
(45) Date of Patent: Feb. 16, 2021

(54) SYSTEM AND METHOD FOR GENERATING A SELF-STEERING BEAMFORMER

(71) Applicant: NUANCE COMMUNICATIONS, INC., Burlington, MA (US)

(72) Inventors: Tobias Wolff, Neu-Ulm (DE); Markus Buck, Biberach (DE)

(73) Assignee: Nuance Communications, Inc., Burlington, MA (US)

( * ) Notice: Subject to any disclaimer, the term of this patent is extended or adjusted under 35 U.S.C. 154(b) by 12 days.

(21) Appl. No.: 15/535,264

(22) PCT Filed: Dec. 12, 2014

(86) PCT No.: PCT/US2014/069948

§ 371 (c)(1),
(2) Date: Jun. 12, 2017

(87) PCT Pub. No.: WO2016/093855

PCT Pub. Date: Jun. 16, 2016

(65) Prior Publication Data

US 2017/0325020 A1 Nov. 9, 2017

(51) Int. Cl.
*H04R 1/40* (2006.01)
*G10L 21/0208* (2013.01)
(Continued)

(52) U.S. Cl.
CPC ..... *H04R 1/406* (2013.01); *G10L 21/0208* (2013.01); *G10L 21/0216* (2013.01);
(Continued)

(58) Field of Classification Search
CPC .... H04R 1/245; H04R 2410/07; H04R 1/406; H04R 2430/23; G10L 2021/02165;
(Continued)

(56) References Cited

U.S. PATENT DOCUMENTS 6,449,586 B1 * 9/2002 Hoshuyama ..... H03H 21/0001 381/92
8,521,530 B1 * 8/2013 Every ..... H04M 9/08 381/66

(Continued)

FOREIGN PATENT DOCUMENTS

EP 0914721 A2 5/1999
EP 1116961 A2 7/2001
WO 2016093855 A1 6/2016

OTHER PUBLICATIONS

Kotta, Acoustic beamforming for Hearing Aids Using Multi Microphone Array by designing Graphical user interface, (Year: 2012).*

(Continued)

*Primary Examiner* — Davetta W Goins
*Assistant Examiner* — Kuassi A Ganmavo
(74) *Attorney, Agent, or Firm* — Brian J. Colandreo; Michael T. Abramson; Holland & Knight LLP

(57) ABSTRACT

A system and method for generating a self-steering beamformer is provided. Embodiments may include receiving, at one or more microphones, a first audio signal and adapting one or more blocking filters based upon, at least in part, the first audio signal. Embodiments may also include generating, using the one or more blocking filters, one or more noise reference signals. Embodiments may further include providing the one or more noise reference signals to an adaptive interference canceller to reduce a beamformer output power level.

20 Claims, 12 Drawing Sheets

Proposed Structure (4 Channels)

(51) Int. Cl.
*G10L 21/0216* (2013.01)
*H04R 1/24* (2006.01)
*G10L 21/0272* (2013.01)

(52) U.S. Cl.
CPC ..... *G10L 21/0272* (2013.01); *G10L 2021/02165* (2013.01); *G10L 2021/02166* (2013.01); *H04R 1/245* (2013.01); *H04R 2410/07* (2013.01); *H04R 2430/23* (2013.01); *H04R 2430/25* (2013.01)

(58) Field of Classification Search
CPC ..... G10L 21/0272; G10L 21/0208; G10L 21/0216; G10L 2021/02166
See application file for complete search history.

(56) References Cited

U.S. PATENT DOCUMENTS

2002/0131580 A1* 9/2002 Smith ..... H04R 3/005 379/387.01
2005/0149320 A1* 7/2005 Kajala ..... G10L 21/0208 704/206
2006/0222184 A1* 10/2006 Buck ..... G10L 21/0208 381/71.1
2007/0076898 A1* 4/2007 Sarroukh ..... G10K 11/341 381/92
2007/0076900 A1* 4/2007 Kellermann ..... H04R 3/005 381/92
2007/0172079 A1 7/2007 Christoph
2007/0274534 A1* 11/2007 Lockhart ..... H04R 1/406 381/92
2007/0276656 A1 11/2007 Solbach et al.
2008/0232607 A1* 9/2008 Tashev ..... G01S 3/86 381/71.11
2010/0246851 A1* 9/2010 Buck ..... G10L 21/0208 381/94.1
2011/0096941 A1 4/2011 Marzetta et al.
2012/0076316 A1* 3/2012 Zhu ..... H04R 3/005 381/71.11
2012/0123772 A1* 5/2012 Thyssen ..... G10L 21/0208 704/226
2012/0294118 A1 11/2012 Haulick et al.
2013/0216064 A1* 8/2013 Kim ..... H04R 3/00 381/86
2014/0153742 A1* 6/2014 Hershey ..... H04B 15/00 381/94.1
2014/0301558 A1* 10/2014 Fan ..... G10L 21/0208 381/71.2

OTHER PUBLICATIONS

International Search Report issued in Application Serial No. PCT/US2014/069948 dated Mar. 24, 2015.
Myllyla et al., "Adaptive beamforming methods for dynamically steered microphone array systems", IEEE International Conference on Acoustics, Speech and Signal Processing (Apr. 4, 2008), pp. 1-4.
Extended European Search Report (EESR) issued in Application Serial No. 14907728.1 dated Jun. 27, 2018.

* cited by examiner

Filter and Sum Beamformer

400

Beamsteering and Beamforming

500

600

Blocking Matrix Structure „Beamformer-Subtraction"

900

GSCwith „Beamformer-Subtraction" Method for Signal Blocking

Proposed Blocking Structure (4 Channels)

1100

SYSTEM AND METHOD FOR GENERATING A SELF-STEERING BEAMFORMER

CROSS-REFERENCE TO RELATED APPLICATION

This application is a U.S. National Stage of International Patent Application No. PCT/US2014/069948, filed on 12 Dec. 2014. The disclosure of which is incorporated herein by reference in its entirety.

TECHNICAL FIELD

This disclosure relates to signal processing and, more particularly, to a method for generating a self-steering beamformer.

BACKGROUND

Beamforming is an effective means for multi-microphone speech signal enhancement because it may reduce noises without introducing speech distortion. This holds true as long as the position of the target speaker is known, the desired signal has similar power at the microphones, and as long as there are only minor sound reflections in the acoustical environment. State of the art beamforming typically relies on these assumptions.

Accordingly, beamforming generally requires knowledge about the relative positions of the microphone array and the desired sound source to be captured. In some cases prior knowledge is present in the form of the angle between the array axis and the speaker (e.g., in the azimuth). The beamformer may then be steered towards this direction such that the desired signals will not be distorted and the noise power is minimized. If the steering angle is known, knowledge about the array geometry may be required to steer the beam towards that direction. Furthermore, the far-field assumption must also hold for the steering to be correct.

Reflections and/or late reverberation may be present meaning that the assumption does not hold and the beamforming is no longer optimal. It may be that there is no direct path connection between the speaker and the microphone array which violates the assumption strongly. From a practical deployment perspective it may be helpful if the processing does not rely on a specific microphone arrangement. Further, there may be significant power differences between the microphones (e.g., for microphones being used mobile phones). Under these practical boundary conditions beamforming shall still provide minimum variance distortionless filtering to enhance the signal.

SUMMARY OF DISCLOSURE

In one implementation, a method, in accordance with this disclosure, may include receiving, at one or more microphones, a first audio signal and adapting one or more blocking filters based upon, at least in part, the first audio signal. The method may also include generating, using the one or more blocking filters, one or more noise reference signals. The method may further include providing the one or more noise reference signals to an adaptive interference canceller to reduce a beamformer output power level.

One or more of the following features may be included. In some embodiments, a speech component of at least one of the one or more microphones may be undistorted. The one or more blocking filters may be configured to perform beamsteering and signal blocking. The one or more blocking filters may be configured to act as phase and amplitude alignment filters. The one or more microphones may include differing channel amplitudes. The one or more blocking filters may not include a steering angle input. In some embodiments, the beamsteering and signal blocking may be performed simultaneously. In some embodiments, adapting may include one or more filter adaptation algorithms. The one or more filter adaptation algorithms may include a normalized least-mean squares algorithm. In some embodiments, the one or more blocking filters may use a primary channel as an input to estimate a signal in a secondary channel.

In another implementation, a system is provided. The system may include one or more processors and one or more microphones configured to receive a first audio signal. The one or more processors may be configured to adapt one or more blocking filters based upon, at least in part, the first audio signal. The one or more processors may be further configured to generate, using the one or more blocking filters, one or more noise reference signals. The one or more processors may be further configured to provide the one or more noise reference signals to an adaptive interference canceller to reduce a beamformer output power level.

One or more of the following features may be included. In some embodiments, a speech component of at least one of the one or more microphones may be undistorted. The one or more blocking filters may be configured to perform beamsteering and signal blocking. The one or more blocking filters may be configured to act as phase and amplitude alignment filters. The one or more microphones may include differing channel amplitudes. The one or more blocking filters may not include a steering angle input. In some embodiments, the beamsteering and signal blocking may be performed simultaneously. In some embodiments, adapting may include one or more filter adaptation algorithms. The one or more filter adaptation algorithms may include a normalized least-mean squares algorithm. In some embodiments, the one or more blocking filters may use a primary channel as an input to estimate a signal in a secondary channel.

The details of one or more implementations are set forth in the accompanying drawings and the description below. Other features and advantages will become apparent from the description, the drawings, and the claims.

BRIEF DESCRIPTION OF THE DRAWINGS

Like reference symbols in the various drawings may indicate like elements.

DETAILED DESCRIPTION OF THE EMBODIMENTS

Embodiments provided herein are directed towards an improved beamforming method that uses a self-steering approach. Accordingly, embodiments disclosed herein may be configured to steer the beam automatically towards a desired sound source and does not require acoustic speaker localization ("ASL") or the use of a number of assumptions that existing systems require.

Figure 1:
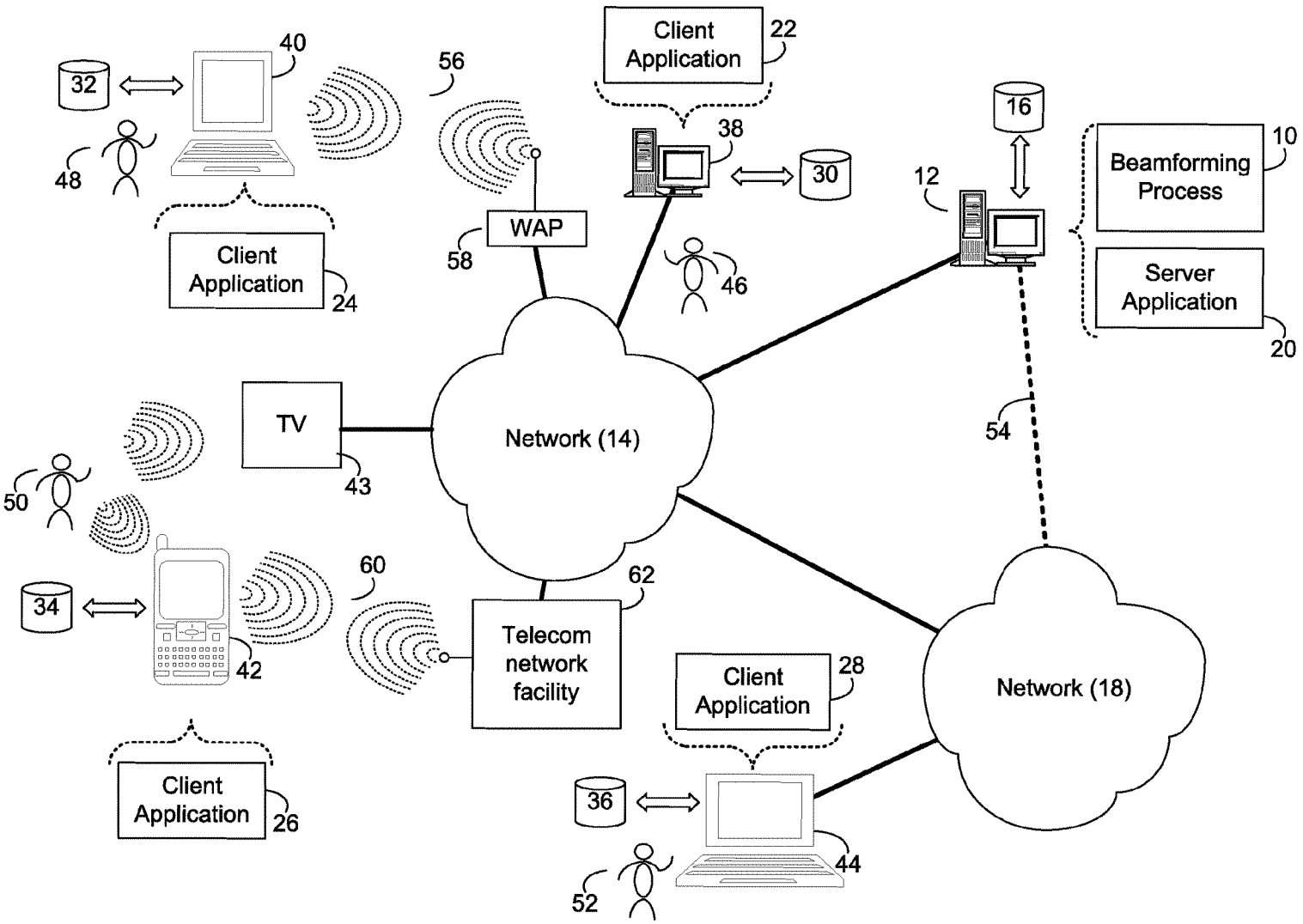
FIG. 1 is a diagrammatic view of a beamforming process in accordance with an embodiment of the present disclosure.
Figure 2:
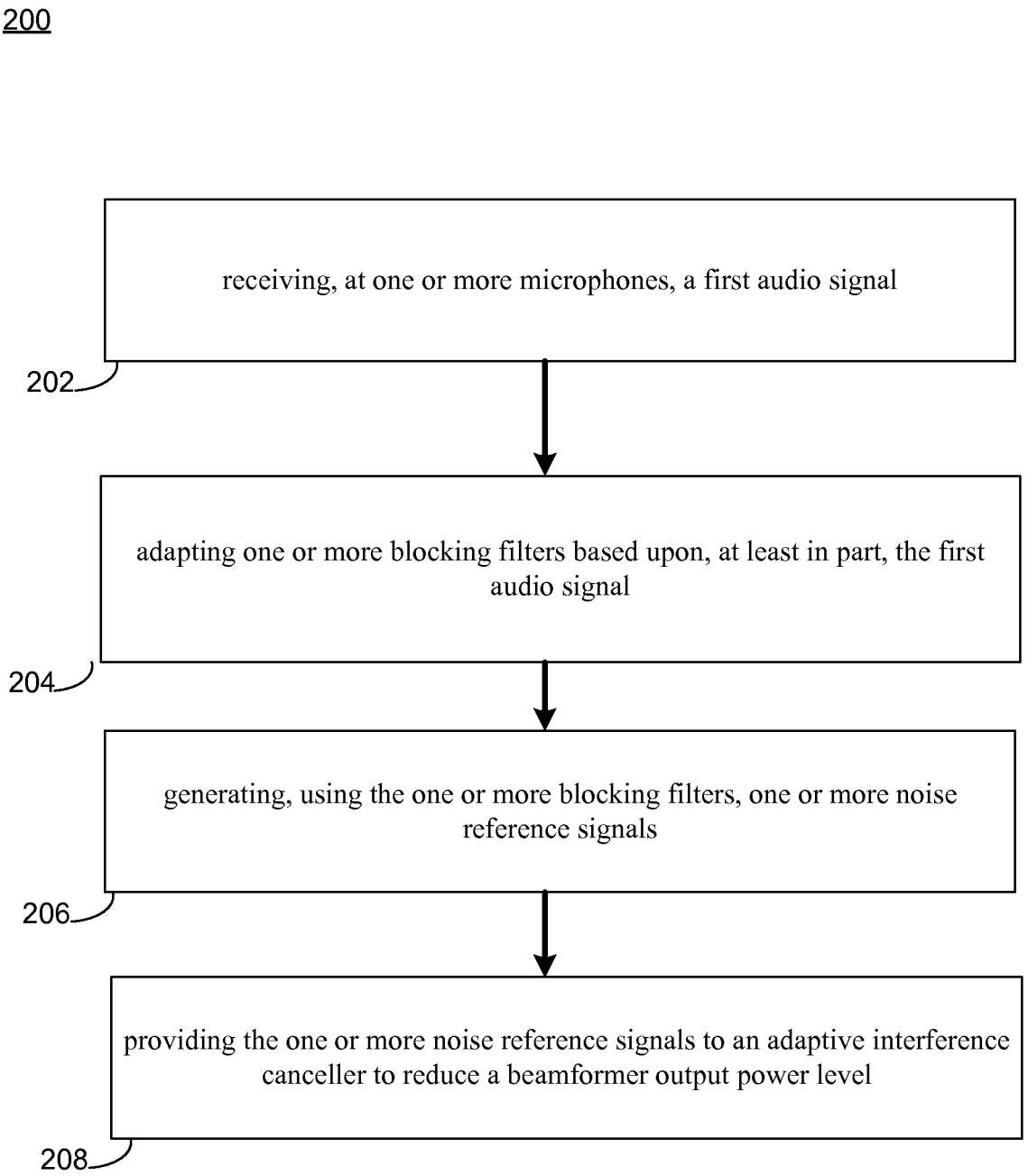
FIG. 2 is a flowchart of a beamforming process in accordance with an embodiment of the present disclosure.

Referring to FIG. 1, there is shown an beamforming process 10 that may reside on and may be executed by any of the devices shown in FIG. 1, for example, computer 12, which may be connected to network 14 (e.g., the Internet or a local area network). Server application 20 may include some or all of the elements of beamforming process 10 described herein. Examples of computer 12 may include but are not limited to a single server computer, a series of server computers, a single personal computer, a series of personal computers, a mini computer, a mainframe computer, an electronic mail server, a social network server, a text message server, a photo server, a multiprocessor computer, one or more virtual machines running on a computing cloud, and/or a distributed system. The various components of computer 12 may execute one or more operating systems, examples of which may include but are not limited to: Microsoft Windows Server™; Novell Netware™; Redhat Linux™, Unix, or a custom operating system, for example.

As will be discussed below in greater detail in FIGS. 2-9, beamforming process 10 may include receiving (202), at one or more microphones, a first audio signal and adapting (204) one or more blocking filters based upon, at least in part, the first audio signal. Embodiments may also include generating (206), using the one or more blocking filters, one or more noise reference signals. Embodiments may further include providing (208) the one or more noise reference signals to an adaptive interference canceller to reduce a beamformer output power level.

The instruction sets and subroutines of beamforming process 10, which may be stored on storage device 16 coupled to computer 12, may be executed by one or more processors (not shown) and one or more memory architectures (not shown) included within computer 12. Storage device 16 may include but is not limited to: a hard disk drive; a flash drive, a tape drive; an optical drive; a RAID array; a random access memory (RAM); and a read-only memory (ROM).

Network 14 may be connected to one or more secondary networks (e.g., network 18), examples of which may include but are not limited to: a local area network; a wide area network; or an intranet, for example.

In some embodiments, beamforming process 10 may be accessed and/or activated via client applications 22, 24, 26, 28. Examples of client applications 22, 24, 26, 28 may include but are not limited to a standard web browser, a customized web browser, or a custom application that can display data to a user. The instruction sets and subroutines of client applications 22, 24, 26, 28, which may be stored on storage devices 30, 32, 34, 36 (respectively) coupled to client electronic devices 38, 40, 42, 44 (respectively), may be executed by one or more processors (not shown) and one or more memory architectures (not shown) incorporated into client electronic devices 38, 40, 42, 44 (respectively).

Storage devices 30, 32, 34, 36 may include but are not limited to: hard disk drives; flash drives, tape drives; optical drives; RAID arrays; random access memories (RAM); and read-only memories (ROM). Examples of client electronic devices 38, 40, 42, 44 may include, but are not limited to, personal computer 38, laptop computer 40, smart phone 42, television 43, notebook computer 44, a server (not shown), a data-enabled, cellular telephone (not shown), and a dedicated network device (not shown).

One or more of client applications 22, 24, 26, 28 may be configured to effectuate some or all of the functionality of beamforming process 10. Accordingly, beamforming process 10 may be a purely server-side application, a purely client-side application, or a hybrid server-side/client-side application that is cooperatively executed by one or more of client applications 22, 24, 26, 28 and beamforming process 10.

Client electronic devices 38, 40, 42, 43, 44 may each execute an operating system, examples of which may include but are not limited to Apple iOS™, Microsoft Windows™, Android™, Redhat Linux™, or a custom operating system. Each of client electronic devices 38, 40, 42, 43, and 44 may include one or more microphones and/or speakers configured to implement beamforming process 10 as is discussed in further detail below.

Users 46, 48, 50, 52 may access computer 12 and beamforming process 10 directly through network 14 or through secondary network 18. Further, computer 12 may be connected to network 14 through secondary network 18, as illustrated with phantom link line 54. In some embodiments, users may access beamforming process 10 through one or more telecommunications network facilities 62.

The various client electronic devices may be directly or indirectly coupled to network 14 (or network 18). For example, personal computer 38 is shown directly coupled to network 14 via a hardwired network connection. Further, notebook computer 44 is shown directly coupled to network 18 via a hardwired network connection. Laptop computer 40 is shown wirelessly coupled to network 14 via wireless communication channel 56 established between laptop computer 40 and wireless access point (i.e., WAP) 58, which is shown directly coupled to network 14. WAP 58 may be, for example, an IEEE 802.11a, 802.11b, 802.11g, Wi-Fi, and/or Bluetooth device that is capable of establishing wireless communication channel 56 between laptop computer 40 and WAP 58. All of the IEEE 802.11x specifications may use Ethernet protocol and carrier sense multiple access with collision avoidance (i.e., CSMA/CA) for path sharing. The various 802.11x specifications may use phase-shift keying (i.e., PSK) modulation or complementary code keying (i.e., CCK) modulation, for example. Bluetooth is a telecommunications industry specification that allows e.g., mobile phones, computers, and smart phones to be interconnected using a short-range wireless connection.

Smart phone 42 is shown wirelessly coupled to network 14 via wireless communication channel 60 established between smart phone 42 and telecommunications network facility 62, which is shown directly coupled to network 14.

The phrase "telecommunications network facility", as used herein, may refer to a facility configured to transmit, and/or receive transmissions to/from one or more mobile devices (e.g. cellphones, etc). In the example shown in FIG. 1, telecommunications network facility 62 may allow for communication between TV 43, cellphone 42 (or television remote control, etc.) and server computing device 12. Embodiments of beamforming process 10 may be used with any or all of the devices described herein as well as many others.

Beamforming, as used herein, may generally refer to a signal processing technique used in sensor arrays for directional signal transmission or reception. Beamforming methods may be used for background noise reduction, particularly in the field of vehicular handsfree systems, but also in other applications. A beamformer may be configured to process signals emanating from a microphone array to obtain a combined signal in such a way that signal components coming from a direction different from a predetermined wanted signal direction are suppressed. Microphone arrays, unlike conventional directional microphones, may be electronically steerable which gives them the ability to acquire a high-quality signal or signals from a desired direction or directions while attenuating off-axis noise or interference. It should be noted that the discussion of beamforming is provided merely by way of example as the teachings of the present disclosure may be used with any suitable signal processing method.

Beamforming, therefore, may provide a specific directivity pattern for a microphone array. In the case of, for example, delay-and-sum beamforming (DSBF), beamforming encompasses delay compensation and summing of the signals. Due to spatial filtering obtained by a microphone array with a corresponding beamformer, it is often possible to improve the signal to noise ratio ("SNR"). However, achieving a significant improvement in SNR with simple DSBF requires an impractical number of microphones, even under idealized noise conditions. Another beamformer type is the adaptive beamformer. Traditional adaptive beamformers optimize a set of channel filters under some set of constraints. These techniques do well in narrowband, far-field applications and where the signal of interest generally has stationary statistics. However, traditional adaptive beamformers are not necessarily as well suited for use in speech applications where, for example, the signal of interest has a wide bandwidth, the signal of interest is non-stationary, interfering signals also have a wide bandwidth, interfering signals may be spatially distributed, or interfering signals are non-stationary. A particular adaptive array is the generalized sidelobe canceller (GSC). The GSC uses an adaptive array structure to measure a noise-only signal which is then canceled from the beamformer output. However, obtaining a noise measurement that is free from signal leakage, especially in reverberant environments, is generally where the difficulty lies in implementing a robust and effective GSC. An example of a beamformer with a GSC structure is described in L. J. Griffiths & C. W. Jim, An Alternative Approach to Linearly Constrained Adaptive Beamforming, in IEEE Transactions on Antennas and Propagation, 1982 pp. 27-34.

Figure 3:
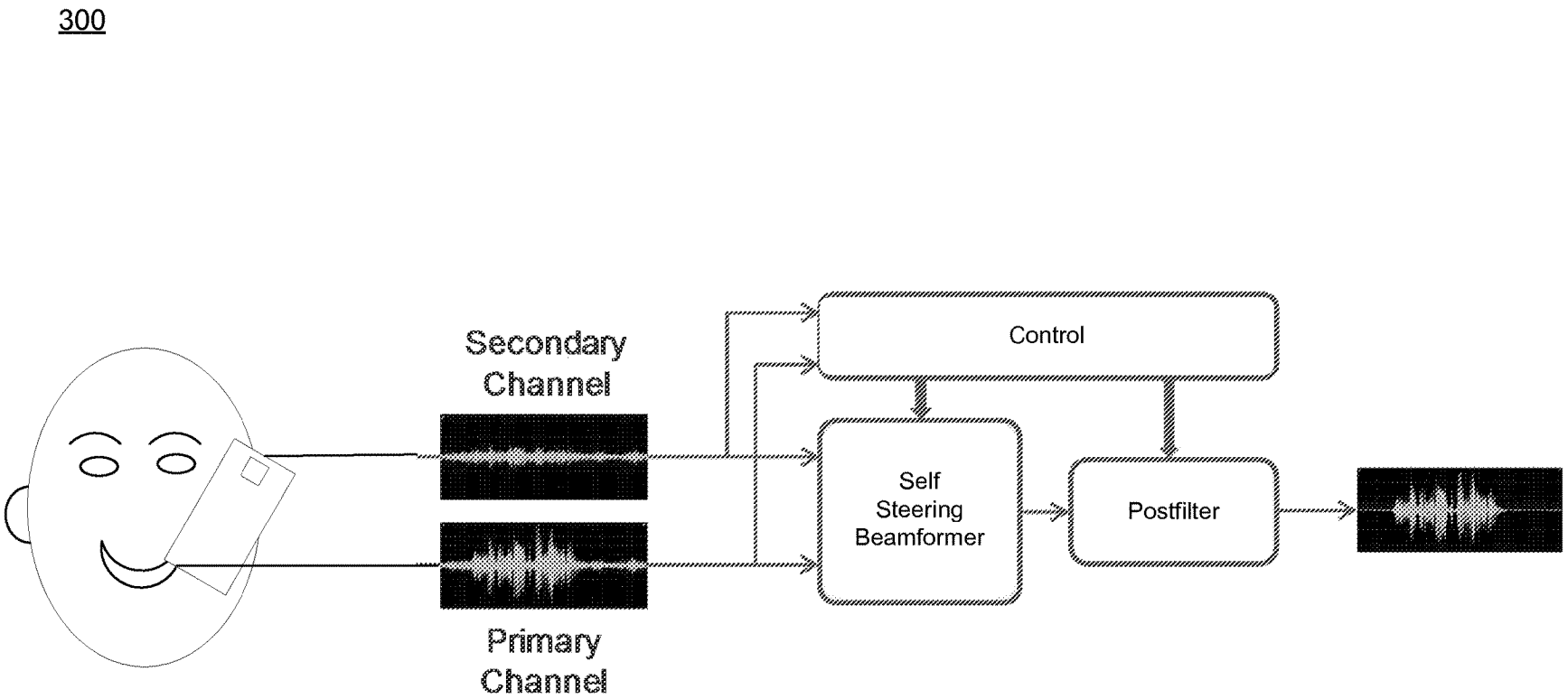
FIG. 3 is a diagrammatic view of a system configured to implement a beamforming process in accordance with an embodiment of the present disclosure.

Referring now to FIG. 3, an embodiment of beamforming process 10 is provided. Beamforming process 10 may be configured to provide multi-channel interference cancellation for mobile devices, such as smartphones. Embodiments of beamforming process 10 may be configured to steer the beam automatically towards a desired sound source and may not rely on acoustic speaker localization (ASL) or the above mentioned assumptions about the desired signal. Additionally and/or alternatively, beamforming process 10 may not rely on a specific microphone array geometry. Accordingly, beamforming process 10 may work for microphone arrangements that result in different signal powers at the microphones (e.g., for smart phones with a second microphone at the back of the device used as noise reference microphone). Existing approaches employ beamforming that is steered by ASL or even require a second beam to achieve the effect of a "broadened" beam to become less sensitive to errors with respect to speaker position. ASL algorithms do not perform well in reverberant and noisy conditions. The use of a second beam helps somewhat but has the drawback of almost doubling CPU requirements and still has a limited sweet spot as well (e.g., 60 degrees).

Embodiments of beamforming process 10 may only require a single beam, may not rely on ASL and does not have the limited sweet spot described above. At the same time the benefits of the beamforming (e.g., noise reduction with ideally zero speech distortion) may be maintained.

Figure 4:
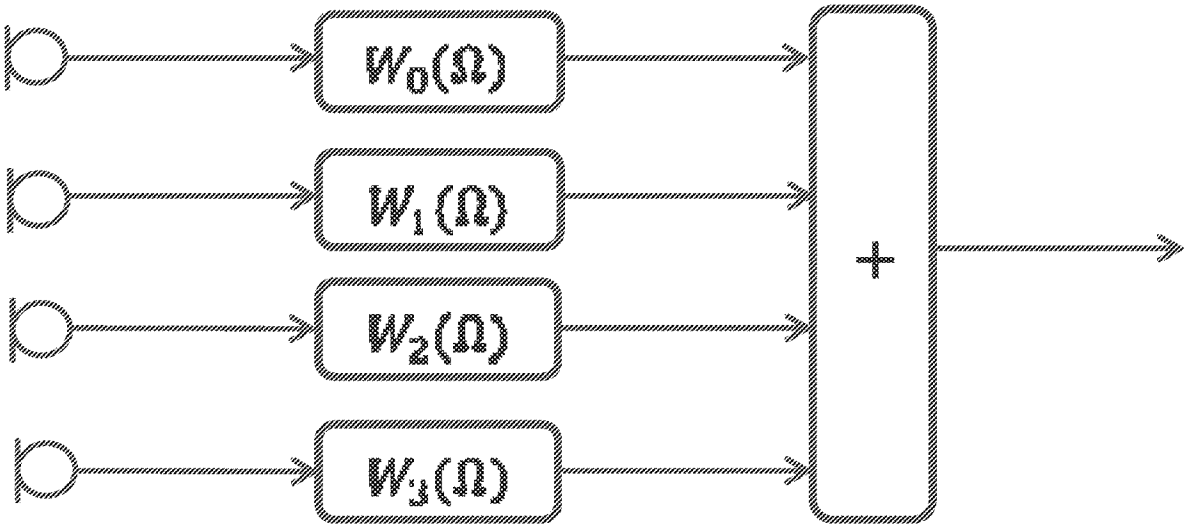
FIG. 4 is a diagrammatic view of a system configured to implement a beamforming process in accordance with an embodiment of the present disclosure.
Figure 5:
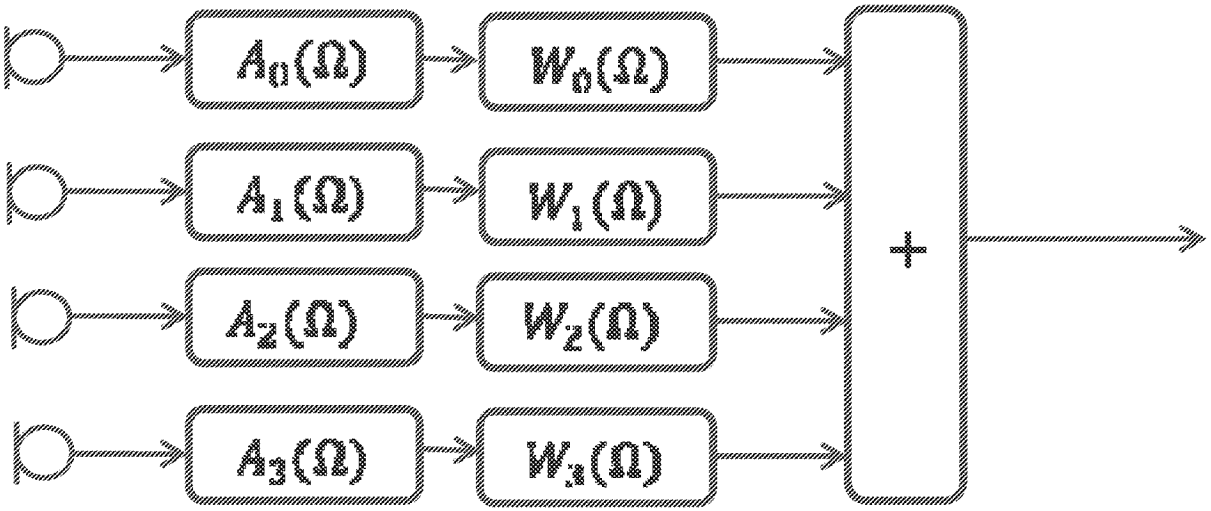
FIG. 5 is a diagrammatic view of a system configured to implement a beamforming process in accordance with an embodiment of the present disclosure.

Referring also to FIG. 4, a filter and sum beamformer ("FSBF") such as those discussed above, may be designed to minimize the noise at the output while leaving the desired speech signal untouched. A beamsteering can be achieved by compensating the time delays between the channels before the filters are applied. These delays are present because the sound hits the microphones at different times depending on the angle of incidence. However, in order to achieve a proper beamsteering these delays may need to be estimated. Accordingly, in existing techniques, it is usually assumed that there is a free sound field without any reflections, which is often unrealistic. Then, the delays could be computed if the angle of incidence was known as well. In this way, the model is required to steer the beam. Whenever the model is not met (in a practical use case) the outcome may not be optimal.

Accordingly, embodiments of beamforming process 10 may be configured to transform the filter and sum structure (see, e.g., FIG. 4) described above into an equivalent representation (e.g., another filter arrangement) that has the advantage that the error with respect to the steering filter becomes available. This error may then be minimized for the signals that are actually observed and the beamsteering may be performed in an adaptive way.

Consequently, all the above mentioned assumptions (e.g., the free field model with known angle) are obsolete. Since both beamformers (e.g., "filter and sum" and "self-steered") may be equivalent with respect to their optimal solution, the benefits remain the same (e.g., only the filter structure changes).

Figure 6:
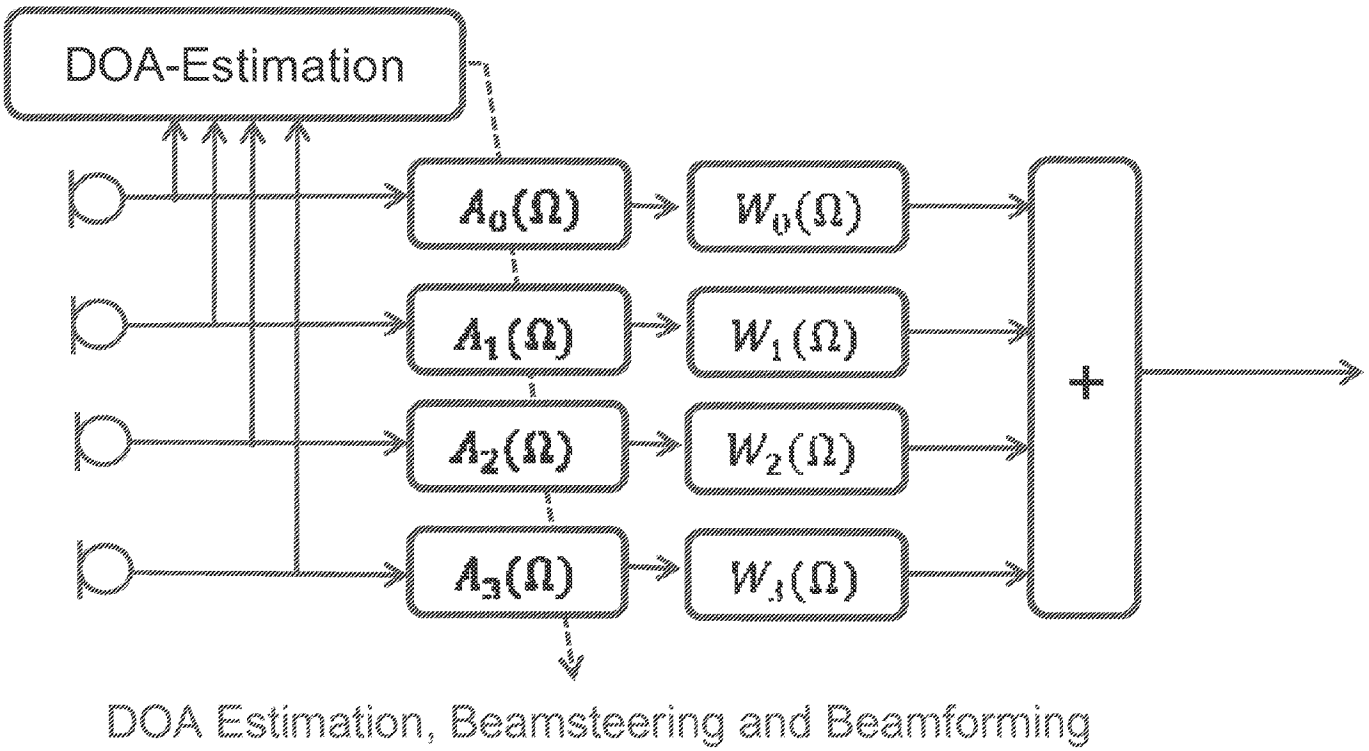
FIGS. 6 is a diagrammatic view of a system configured to implement a beamforming process in accordance with an embodiment of the present disclosure.

Existing approaches in this field may use a direction of arrival estimator to find the angle of incidence of the desired signal. In a second stage, the beamforming may be steered towards this direction. Both beamsteering (see, e.g., FIG. 5) and DOA-Estimation (see, e.g., FIG. 6) may make use of the above mentioned assumptions. In FIG. 6, it should be noted that the DOA estimation itself does not change the signals but only steers the time delay compensation stage. Beamforming, adaptive beamforming, and beamsteering are all discussed in further detail below.

Beamforming

Let $\underline{W}(e^{j\Omega\mu})=(W_0(e^{j\Omega\mu}), \ldots, W_{M-1}(e^{j\Omega\mu}))^T$ be the vector of beamformer filters and $\underline{X}(e^{j\Omega\mu})=(X_0(e^{j\Omega\mu}), \ldots, X_{M-1}(e^{j\Omega\mu}))^T$ the vector of complex valued microphone microphone spectra. The beamformed signal can then be written as the inner product.

$$A(e^{j\Omega\mu})=\underline{W}^H(e^{j\Omega\mu})\underline{X}(e^{j\Omega\mu}). \tag{1.1}$$

Often the filters are designed to meet the so called minimum variance distortionless response ("MVDR") criterion:

$$\underset{\underline{w}}{argmin}\ \underline{W}^H(e^{j\Omega\mu})\Phi_{xx}(e^{j\Omega\mu})\underline{W}(e^{j\Omega\mu}), \text{ whereas } \underline{C}^H(e^{j\Omega\mu})\underline{W}(e^{j\Omega\mu})\overset{!}{=}1. \tag{1.2}$$

This design leads to the following filters:

$$\underline{W}(e^{j\Omega\mu})\,|\,MVDR=\frac{\Phi_{vv}^{-1}(e^{j\Omega\mu})\underline{C}(e^{j\Omega\mu})}{\underline{C}^H(e^{j\Omega\mu})\Phi_{vv}^{-1}(e^{j\Omega\mu})\underline{C}(e^{j\Omega\mu})} \tag{1.3}$$

These filters hence minimize the output variance under the constraint of no distortions given the acoustic transfer functions $\underline{F}(e^{j\Omega\mu})=(F_0(e^{j\Omega\mu}), \ldots, F_{M-1}(e^{j\Omega\mu}))^T$ obey those assumed in the constraint vector $\underline{C}^H(e^{j\Omega\mu})$. Here, $\Phi_{vv}(e^{j\Omega\mu})$ denotes the covariance matrix of the noise at the microphones whereas $\Phi_{xx}(e^{j\Omega\mu})$ is the covariance matrix of the microphone signals.

Adaptive Beamforming

Figure 7:
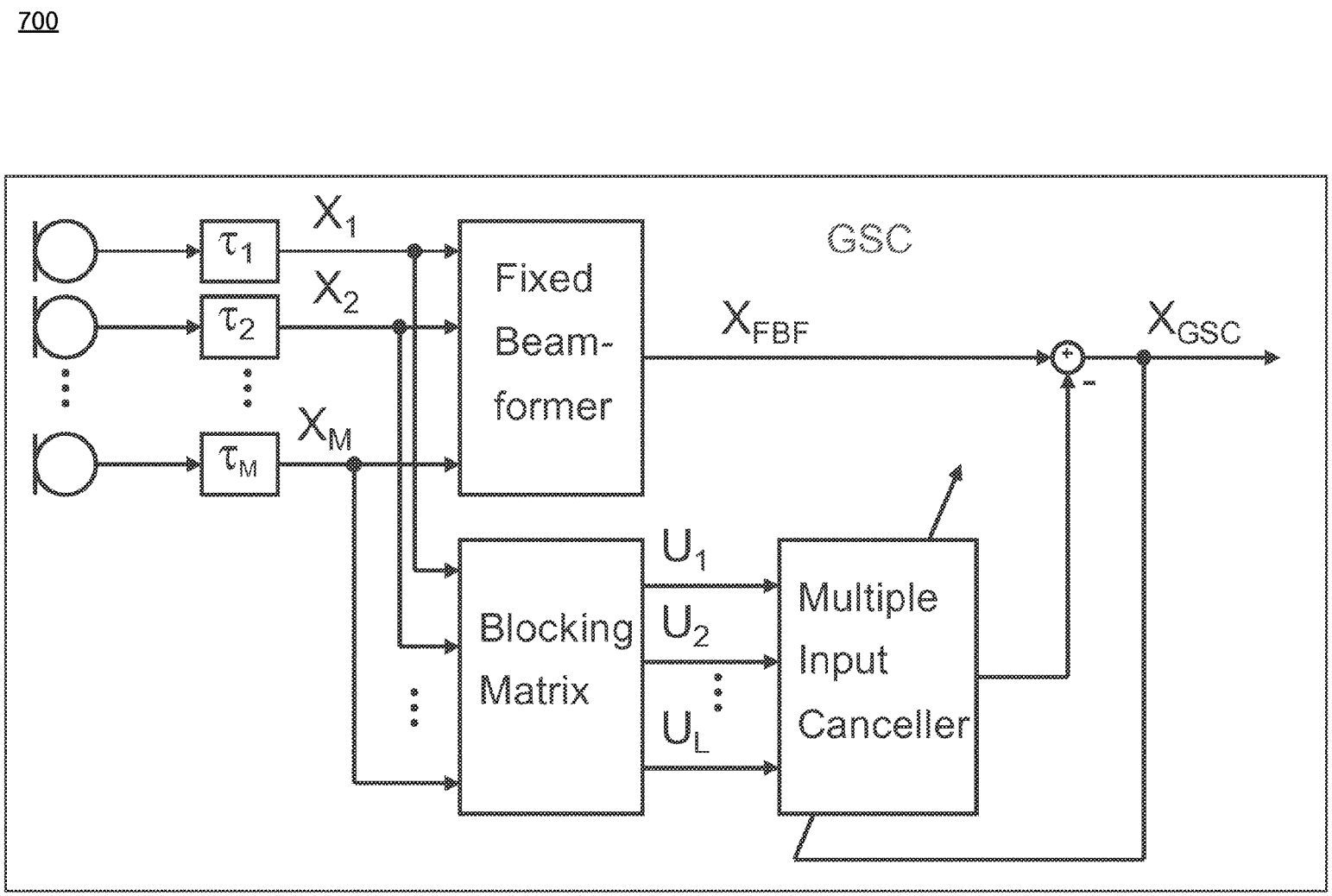
FIG. 7 is a diagrammatic view of a system configured to implement a beamforming process in accordance with an embodiment of the present disclosure.

It is desired to implement a beamformer according to the MVDR design such that it adapts automatically to the present noise field rather than an assumed field (model). This can be achieved using a Generalized Sidelobe Canceller Structure ("GSC") as it is depicted in FIG. 7.

The principle is to decompose the constrained minimization problem into the constraint and the minimization by choosing a certain processing structure:

$$\underline{W}(e^{j\Omega\mu})|_{MVDR}=\underline{W}_f(e^{j\Omega\mu})-\underline{W}_\Delta(e^{j\Omega\mu}). \tag{1.4}$$

Here, it is essential that $\underline{W}_\Delta(e^{j\Omega\mu})$ is orthogonal to the constraint: $\underline{C}^H(e^{j\Omega\mu})\underline{W}_\Delta(e^{j\Omega\mu})=0$. As the entire MVDR-vector satisfies the constraint, the same must therefore hold with respect to the so-called fixed beamformer: $\underline{C}^H(e^{j\Omega\mu})\underline{W}_f(e^{j\Omega\mu})=1$.

The second vector $W_\Delta(e^{j\Omega\mu})$ is now represented as a matrix vector product.

$$\underline{W}_\Delta(e^{j\Omega\mu})=B(e^{j\Omega\mu})\cdot\underline{W}_{ic}^H(e^{j\Omega\mu}), \tag{1.5}$$

whereas the matrix $B(e^{j\Omega\mu})$ is designed such that $W_\Delta(e^{j\Omega\mu})$ is always orthogonal to the constraint vector, regardless of $\underline{W}_{ic}^H(e^{j\Omega\mu})$. The latter can then be used to minimize the power at the beamformer output.

As the matrix $B(e^{j\Omega\mu})$ projects all those signals into the nullspace (e.g., rejects them) that are protected by the distortionless response constraint, it is often referred to as "blocking matrix." The signals at the output of the blocking matrix are free of the desired signal components—hence contain only some filtered noise. These noise reference signals are then used to carry out the minimization.

Figure 8:
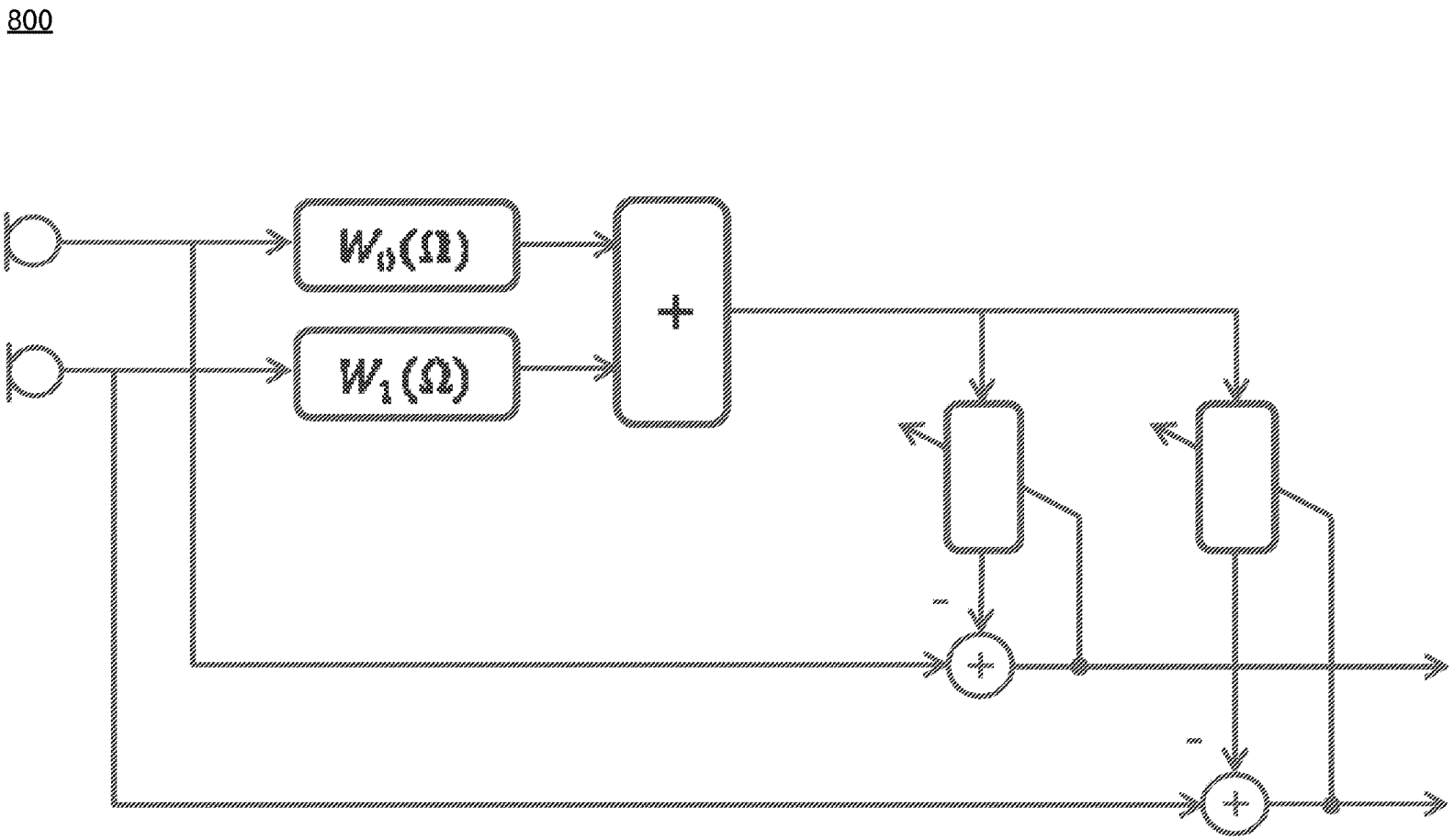
FIGS. 8 is a diagrammatic view of a system configured to implement a beamforming process in accordance with an embodiment of the present disclosure.
Figure 9:
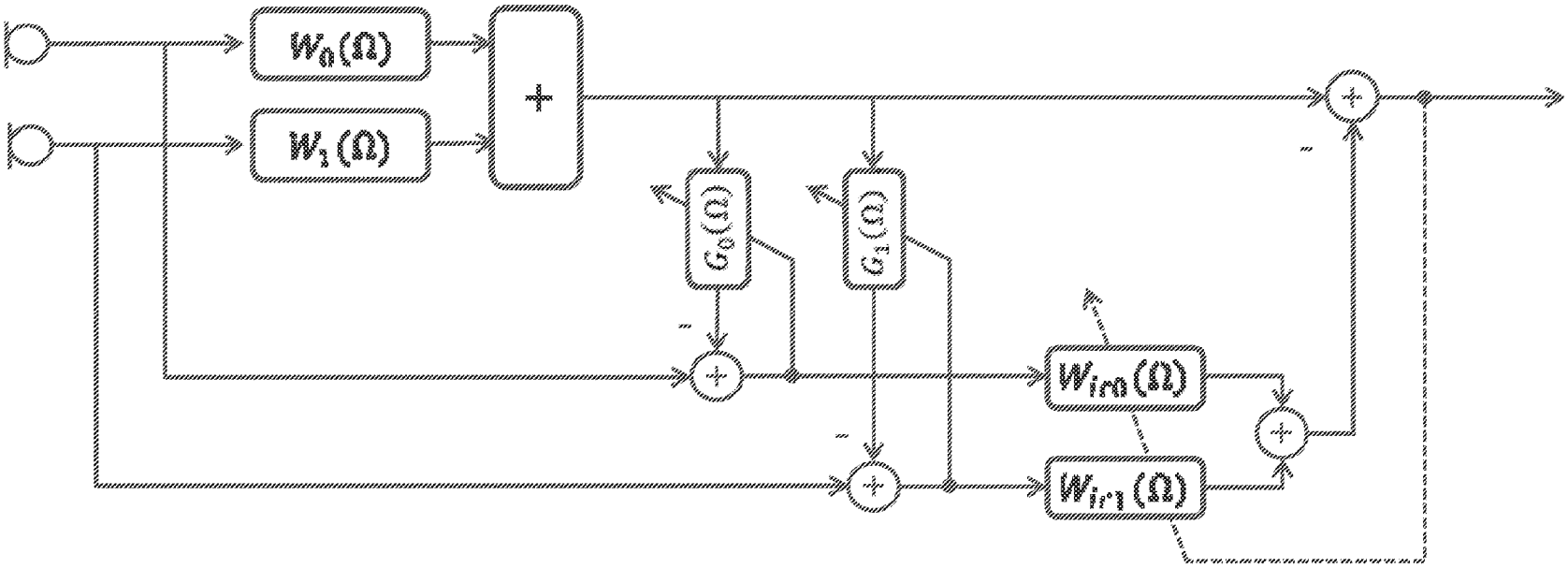
FIG. 9 is a diagrammatic view of a system configured to implement a beamforming process in accordance with an embodiment of the present disclosure.
Figure 10:
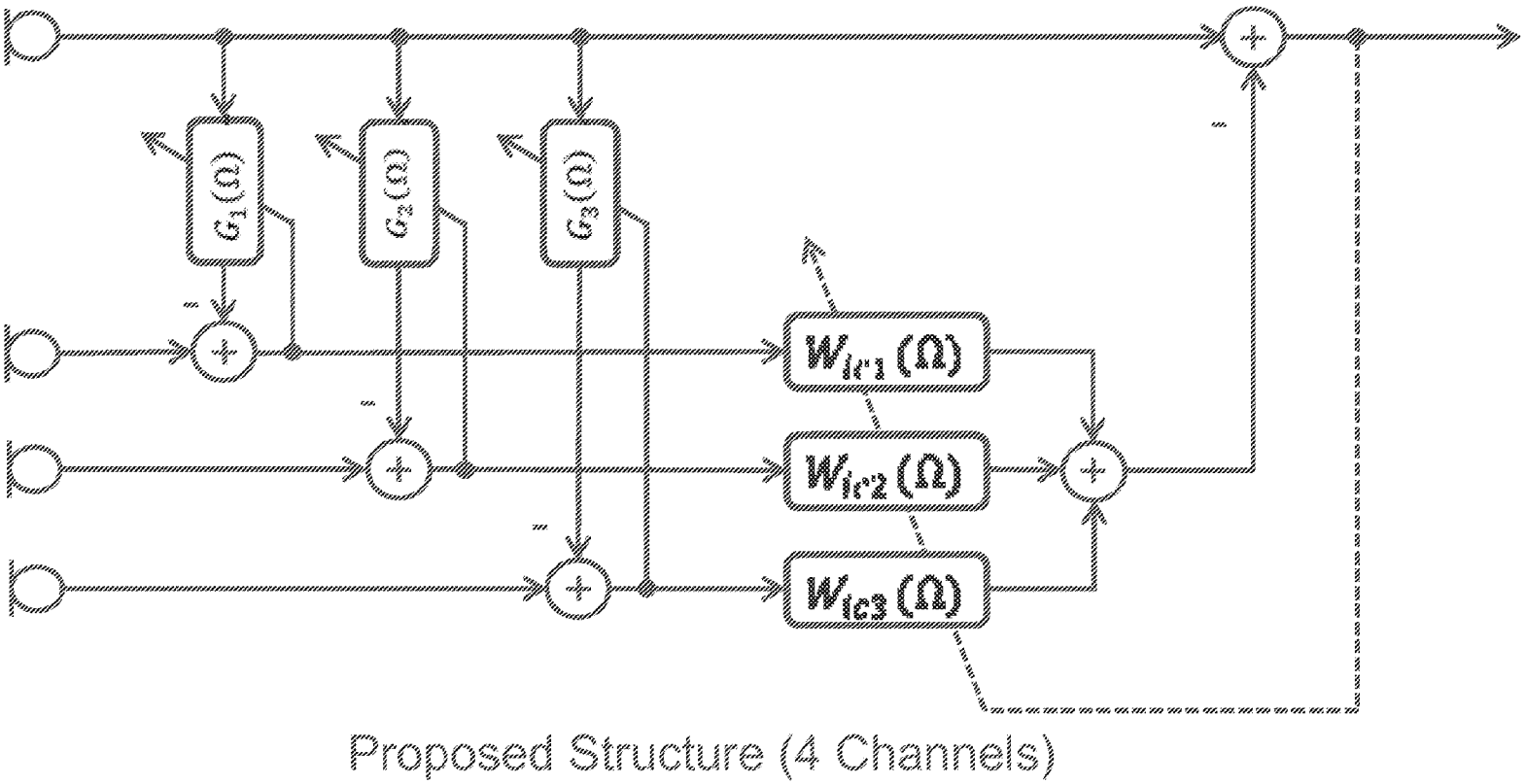
FIG. 10 is a diagrammatic view of a system configured to implement a beamforming process in accordance with an embodiment of the present disclosure.

In some cases, the blocking matrix may be implemented using adaptive filters to achieve a more robust performance with respect to distortions of the desired signal. One way to implement such an adaptive blocking structure is to use the (existing) signal after the fixed beamformer and to feed it into a set of adaptive filters whose output signals are used to cancel the desired signal components in each of the microphone signals. This blocking structure is depicted in FIG. 8 and is referred to here as the "Beamformer-Subtraction Method." Note, that the beamformer subtraction method relies on a beamformer with correct beamsteering, which is discussed in further detail hereinbelow.

Beamsteering

The MVDR solution as presented above requires the knowledge of the acoustic transfer functions $F_m(e^{j\Omega\mu})$. The most common way to deal with this is to assume those were actually all-pass filters:

$$F_m(e^{j\Omega\mu})=\exp\{-jw_{Tm}\}. \tag{1.6}$$

In addition the time delay $_{Tm}$ is assumed to be frequency independent yielding a linear phase response. These assumptions are equivalent to assuming a free sound field with respect to the desired signal and that the source is in the far-field of the microphone array. In this case, only the channels difference in terms of time delay must be compensated in order to obtain identical source signals in the different microphone channels. This is achieved by the filters $A_m(e^{j\Omega\mu})$:

$$A_m(e^{j\Omega\mu})=\exp\{-jw_{Tm}\}\cdot\exp\{-jw_{Tref}\}. \tag{1.7}$$

Here, the term $T_{ref}$ denotes the time-delay from the source to the chosen reference point (often, the center of the microphone array may be used as a reference point). Hence, the received microphone signals are usually time-aligned by filtering with the filters $A_m(e^{j\Omega\mu})$ before the actual beamforming filters are applied (see, FIG. 5).

The filters $A_m(e^{j\Omega\mu})$ have the effect of steering the beam to the spatial direction for which the delays are compensated—independent of the actual beamformer.

The beamformer, however, is then typically designed under the assumption of having identical desired signals in the different channels.

The classical beamsteering therefore relies on a number of assumptions. Some of these may include that the filters have a linear phase, the geometry of the microphone array is known, the steering angle (respectively $_{Tm}$) is known a priori, and the filters $F_m(e^{j\Omega\mu})$ do not introduce amplitude differences between the channels $$(|F_m(e^{j\Omega\mu})|=|F_n(e^{j\Omega\mu})|\forall=_{m\neq n})$$

Embodiments of beamforming process 10 may be used to design an MVDR beamformer such that the speech component of one particular microphone (e.g., the primary microphone) will remain undistorted. Accordingly, beamforming process 10 may utilize a particular blocking filter arrangement whose filters may be found adaptively without relying on any prior knowledge such as a steering angle. This blocking filter arrangement may be used to generate noise reference signals for an adaptive interference canceller in order to minimize the power at the beamformer output.

In this way, a goal is to design an adaptive MVDR beamformer that does not rely on the above mentioned assumptions. This may be achieved by choosing the constraint vector $\underline{C}(e^{j\Omega\mu})$ as $$C(e^{j\Omega\mu})=[1, F_1(e^{j\Omega\mu}), \ldots, F_{M-1}(e^{j\Omega\mu})]^T. \tag{2.1}$$

This means we assume only the first channel to be an all-pass filter and tolerate that the actual acoustic channel $F_0(e^{j\Omega\mu})$ won't be equalized by the beamformer. Hence, the first channel acts as the so-called primary channel whose signal we want to preserve by means of the constraint.

Figure 11:
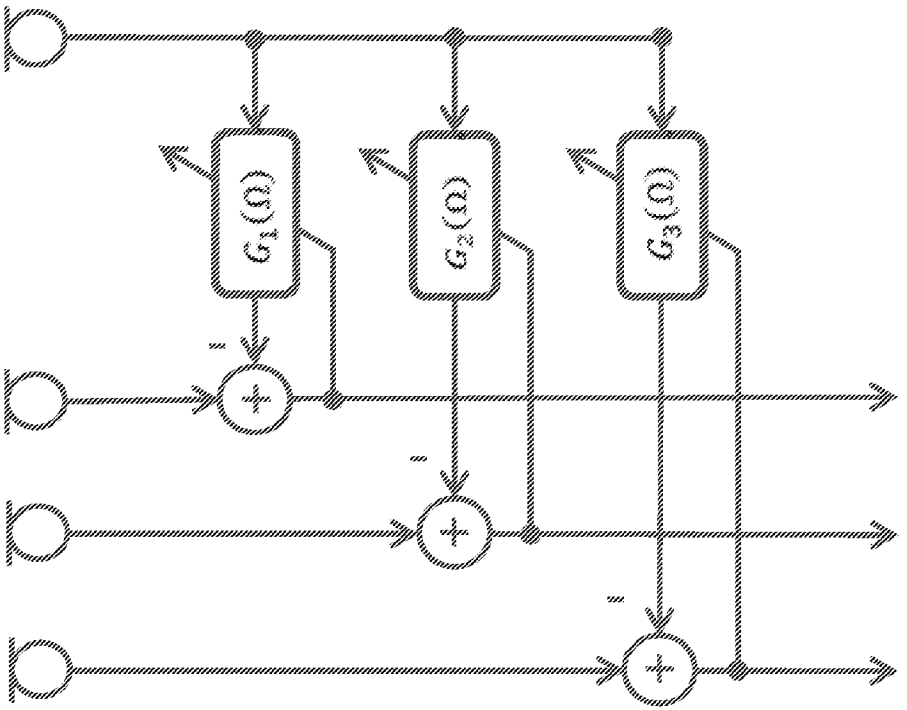
FIG. 11 is a diagrammatic view of a system configured to implement a beamforming process in accordance with an embodiment of the present disclosure.

A possible blocking matrix for this vector to fulfill the orthogonality constraint is:

$$B(e^{j\Omega\mu})=[O_{M-1\times 1}I_{M-1\times M-1}]-[\underline{\mathfrak{G}}(e^{j\Omega\mu})O_{M-1\times M-1}], \quad (2.2)$$

Where $\underline{\mathfrak{G}}(e^{j\Omega\mu})=(G_1(e^{j\Omega\mu}), \ldots, G_{M-1}(e^{j\Omega\mu})^T$ is the vector of adaptive blocking filters excluding the one of the primary channel. This particular structure has the advantage that it does not rely on time-aligned signals at its input (see FIG. 11). Note that the "beamformer subtraction method" for signal blocking, which was mentioned above, does not have this property for instance.

The least squares solutions for the filters $G_q(e^{j\Omega\mu})$ is:

$$G_q(e^{j\Omega\mu})=F_q(e^{j\Omega\mu})\forall q=1, \ldots, M-1. \quad (2.3)$$

If the assumptions that are used in beamsteering are met and the primary channel and ($T_{ref}=T_0$) is used, we have:

$$G_q(e^{j\Omega\mu})=A_q(e^{j\Omega\mu}). \quad (2.4)$$

As can be seen from this, the blocking filters $G_q(e^{j\Omega\mu})$ act as alignment filters. The alignment, however, does not only refer to phase but also to amplitude. Additionally, no linear phase is required. In a practical system, the optimal solution for the filters can be found by minimizing the power at the output of the blocking structure (after subtraction) in the mean. To this end known algorithms such as normalized least-mean squares algorithm ("NLMS") can be used for filter adaptation (see FIG. 11).

The error or output signals of the proposed blocking matrix may be fed to a set of interference cancelation filters as it is known from the GSC-structure to implement the unconstrained minimization.

Embodiments of beamforming process 10 may utilize a self-steering beamformer that may be adapted with respect to speech and noise. Therefore, a preliminary distinction between both may be necessary. Here, various concepts for Voice Activity Detection (VAD) can be applied to control the adaptive filters. The blocking filters may be adapted whenever a desired signal is detected, whereas the interference canceller filters should be adapted if no desired signal is present. A suitable stepsize control for the adaptive filters may also be implemented without departing from the teachings of the present disclosure.

In some embodiments, one approach may involve the Signal to Noise Ratio ("SNR"). Another source of information is the Coherent to Diffuse Ratio ("CDR") which helps to adapt the beamformer to coherent sounds only.

In applications where the signal power ratios carry information about the desired signal those can be used as well. Although, the self-steering beamformer does not assume a certain spatial direction for the desired signal, this may still be used as a control means. Such a measure could be the power ratio between a blocking matrix output signal and a fixed beamformer signal.

In some embodiments, the filters $G_q(\omega)$ may serve multiple functions in the proposed beamforming structure as they implement the beamsteering and the signal blocking at the same time. The great advantage is that the alignment can be done adaptively as the required error signals become available as a consequence of the chosen structure. The advantage of the GSC-structure (unconstrained minimization of the output energy) is preserved and thereby this type of beamforming may be adapted to both the desired signal and the present noise field without relying on the usual assumptions for the desired signal. The beamsteering is now intrinsic and, as such, functions in a self-steering manner. If the usual assumptions made in beamforming are actually met the proposed self-steering beamformer converges to the same solution as the classical beamformers, with the difference that it finds the steering on its own.

Some embodiments of beamforming process 10 may be used in situations where the channel amplitudes differ significantly. Some of these may include, but are not limited to, mobile phones having a second microphone on the back of the device. Another such use case is a distributed microphone setup that may be used in a car where each passenger has a dedicated microphone and only the drivers voice shall be preserved.

Referring again to FIG. 11, an embodiment depicting a proposed blocking structure consistent with beamforming process 10 is provided. If the blocking filter uses the primary channel as input to estimate the signal in the other channels (as proposed herein), beamforming process 10 may also work if faced with different microphone power levels. If there are different signal powers, the SNR is best in the primary channel.

In contrast, prior approaches attempted to place the filter in the non-primary channel, which is disadvantageous, because the input signal determines the gradient for the filter-update. Accordingly, poor input SNR results in poor convergence. If there is very good decoupling (e.g., a mobile phone held at the ear for instance), the blocking filter in the non-primary channel, adapts to the correlation present between the noises in the respective channels. In this case, the non-primary channel blocking filter approach no longer works, because the blocking filter output is no longer correlated with the primary signal and no noise cancellation can be done by the IC-filters, on the contrary, the input signal for the IC-filters then strongly correlates to the primary channel as it contains the phase inverted primary signal, which results in distortions of the desired signal.

Embodiments of beamforming process 10 may act as a pure interference canceller in the described case while it also works well in the scenario with equal signal powers. In the case of no desired signal component at the non-primary microphones the existing systems would cancel the desired signal, while embodiments of beamforming process 10 provides ideal conditions for cancelling the noise.

Figure 12:
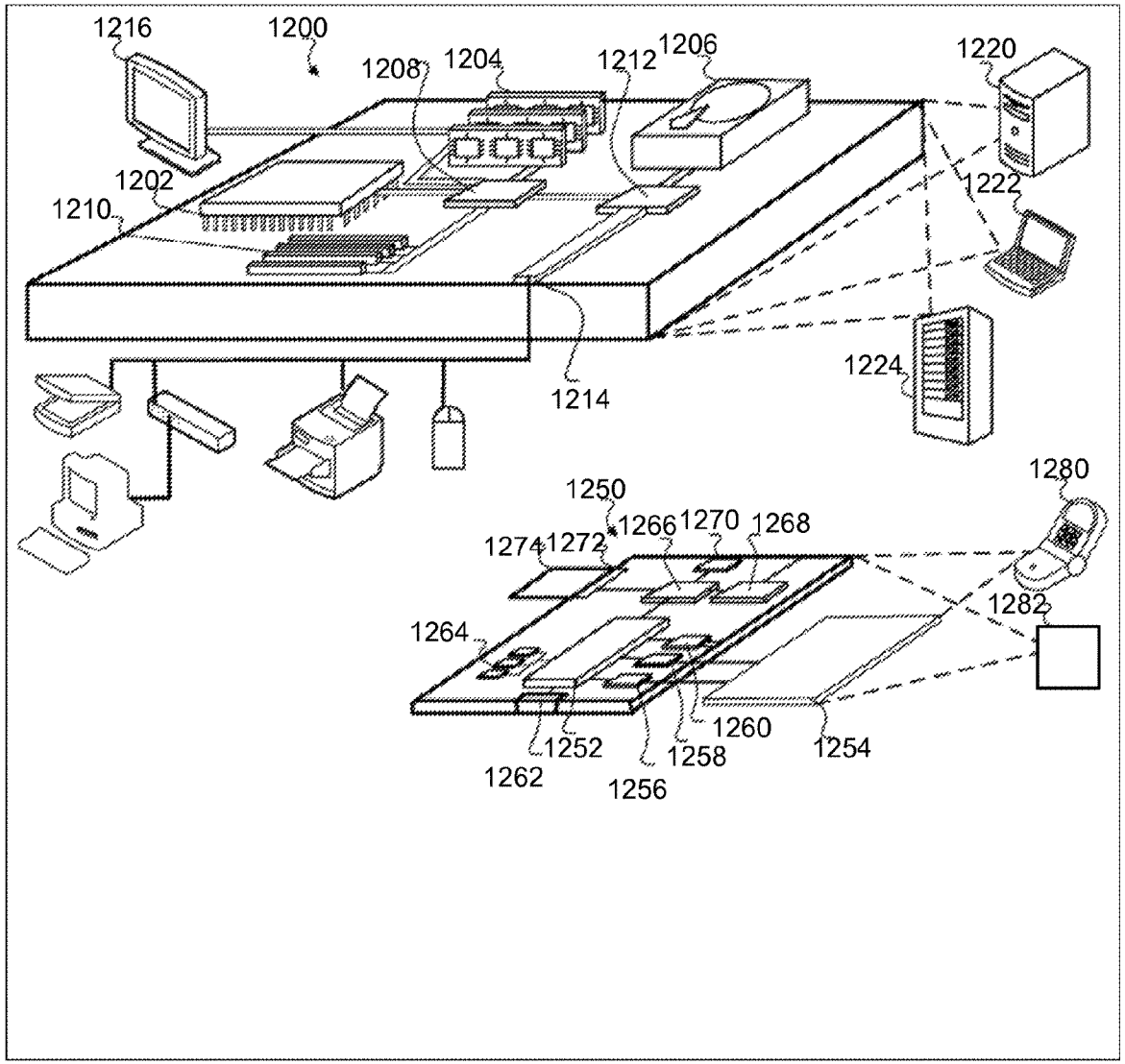
FIG. 12 shows an example of a computer device and a mobile computer device that can be used to implement embodiments of the present disclosure.

Referring now to FIG. 12, an example of a generic computer device 1200 and a generic mobile computer device 1250, which may be used with the techniques described here is provided. Computing device 1200 is intended to represent various forms of digital computers, such as tablet computers, laptops, desktops, workstations, personal digital assistants, servers, blade servers, mainframes, and other appropriate computers. In some embodiments, computing device 1250 can include various forms of mobile devices, such as personal digital assistants, cellular telephones, smartphones, and other similar computing devices. Computing device 1250 and/or computing device 1200 may also include other devices, such as televisions with one or more processors embedded therein or attached thereto as well as any of the microphones, microphone arrays, and/or speakers described herein. The components shown here, their connections and relationships, and their functions, are meant to be exemplary only, and are not meant to limit implementations of the inventions described and/or claimed in this document.

In some embodiments, computing device 1200 may include processor 1202, memory 1204, a storage device

1206, a high-speed interface 1208 connecting to memory 1204 and high-speed expansion ports 1210, and a low speed interface 1212 connecting to low speed bus 1214 and storage device 1206. Each of the components 1202, 1204, 1206, 1208, 1210, and 1212, may be interconnected using various busses, and may be mounted on a common motherboard or in other manners as appropriate. The processor 1202 can process instructions for execution within the computing device 1200, including instructions stored in the memory 1204 or on the storage device 1206 to display graphical information for a GUI on an external input/output device, such as display 1216 coupled to high speed interface 1208. In other implementations, multiple processors and/or multiple buses may be used, as appropriate, along with multiple memories and types of memory. Also, multiple computing devices 1200 may be connected, with each device providing portions of the necessary operations (e.g., as a server bank, a group of blade servers, or a multi-processor system).

Memory 1204 may store information within the computing device 1200. In one implementation, the memory 1204 may be a volatile memory unit or units. In another implementation, the memory 1204 may be a non-volatile memory unit or units. The memory 1204 may also be another form of computer-readable medium, such as a magnetic or optical disk.

Storage device 1206 may be capable of providing mass storage for the computing device 1200. In one implementation, the storage device 1206 may be or contain a computer-readable medium, such as a floppy disk device, a hard disk device, an optical disk device, or a tape device, a flash memory or other similar solid state memory device, or an array of devices, including devices in a storage area network or other configurations. A computer program product can be tangibly embodied in an information carrier. The computer program product may also contain instructions that, when executed, perform one or more methods, such as those described above. The information carrier is a computer- or machine-readable medium, such as the memory 1204, the storage device 1206, memory on processor 1202, or a propagated signal.

High speed controller 1208 may manage bandwidth-intensive operations for the computing device 1200, while the low speed controller 1212 may manage lower bandwidth-intensive operations. Such allocation of functions is exemplary only. In one implementation, the high-speed controller 1208 may be coupled to memory 1204, display 1216 (e.g., through a graphics processor or accelerator), and to high-speed expansion ports 1210, which may accept various expansion cards (not shown). In the implementation, low-speed controller 1212 is coupled to storage device 1206 and low-speed expansion port 1214. The low-speed expansion port, which may include various communication ports (e.g., USB, Bluetooth, Ethernet, wireless Ethernet) may be coupled to one or more input/output devices, such as a keyboard, a pointing device, a scanner, or a networking device such as a switch or router, e.g., through a network adapter.

Computing device 1200 may be implemented in a number of different forms, as shown in the figure. For example, it may be implemented as a standard server 1220, or multiple times in a group of such servers. It may also be implemented as part of a rack server system 1224. In addition, it may be implemented in a personal computer such as a laptop computer 1222. Alternatively, components from computing device 1200 may be combined with other components in a mobile device (not shown), such as device 1250. Each of such devices may contain one or more of computing device 1200, 1250, and an entire system may be made up of multiple computing devices 1200, 1250 communicating with each other.

Computing device 1250 may include a processor 1252, memory 1264, an input/output device such as a display 1254, a communication interface 1266, and a transceiver 1268, among other components. The device 1250 may also be provided with a storage device, such as a microdrive or other device, to provide additional storage. Each of the components 1250, 1252, 1264, 1254, 1266, and 1268, may be interconnected using various buses, and several of the components may be mounted on a common motherboard or in other manners as appropriate.

Processor 1252 may execute instructions within the computing device 1250, including instructions stored in the memory 1264. The processor may be implemented as a chipset of chips that include separate and multiple analog and digital processors. The processor may provide, for example, for coordination of the other components of the device 1250, such as control of user interfaces, applications run by device 1250, and wireless communication by device 1250.

In some embodiments, processor 1252 may communicate with a user through control interface 1258 and display interface 1256 coupled to a display 1254. The display 1254 may be, for example, a TFT LCD (Thin-Film-Transistor Liquid Crystal Display) or an OLED (Organic Light Emitting Diode) display, or other appropriate display technology. The display interface 1256 may comprise appropriate circuitry for driving the display 1254 to present graphical and other information to a user. The control interface 1258 may receive commands from a user and convert them for submission to the processor 1252. In addition, an external interface 1262 may be provide in communication with processor 1252, so as to enable near area communication of device 1250 with other devices. External interface 1262 may provide, for example, for wired communication in some implementations, or for wireless communication in other implementations, and multiple interfaces may also be used.

In some embodiments, memory 1264 may store information within the computing device 1250. The memory 1264 can be implemented as one or more of a computer-readable medium or media, a volatile memory unit or units, or a non-volatile memory unit or units. Expansion memory 1274 may also be provided and connected to device 1250 through expansion interface 1272, which may include, for example, a SIMM (Single In Line Memory Module) card interface. Such expansion memory 1274 may provide extra storage space for device 1250, or may also store applications or other information for device 1250. Specifically, expansion memory 1274 may include instructions to carry out or supplement the processes described above, and may include secure information also. Thus, for example, expansion memory 1274 may be provide as a security module for device 1250, and may be programmed with instructions that permit secure use of device 1250. In addition, secure applications may be provided via the SIMM cards, along with additional information, such as placing identifying information on the SIMM card in a non-hackable manner.

The memory may include, for example, flash memory and/or NVRAM memory, as discussed below. In one implementation, a computer program product is tangibly embodied in an information carrier. The computer program product may contain instructions that, when executed, perform one or more methods, such as those described above. The information carrier may be a computer- or machine-readable medium, such as the memory 1264, expansion memory 1274, memory on processor 1252, or a propagated signal that may be received, for example, over transceiver 1268 or external interface 1262.

Device 1250 may communicate wirelessly through communication interface 1266, which may include digital signal processing circuitry where necessary. Communication interface 1266 may provide for communications under various modes or protocols, such as GSM voice calls, SMS, EMS, or MMS speech recognition, CDMA, TDMA, PDC, WCDMA, CDMA2000, or GPRS, among others. Such communication may occur, for example, through radio-frequency transceiver 1268. In addition, short-range communication may occur, such as using a Bluetooth, WiFi, or other such transceiver (not shown). In addition, GPS (Global Positioning System) receiver module 1270 may provide additional navigation- and location-related wireless data to device 1250, which may be used as appropriate by applications running on device 1250.

Device 1250 may also communicate audibly using audio codec 1260, which may receive spoken information from a user and convert it to usable digital information. Audio codec 1260 may likewise generate audible sound for a user, such as through a speaker, e.g., in a handset of device 1250. Such sound may include sound from voice telephone calls, may include recorded sound (e.g., voice messages, music files, etc.) and may also include sound generated by applications operating on device 1250.

Computing device 1250 may be implemented in a number of different forms, as shown in the figure. For example, it may be implemented as a cellular telephone 1280. It may also be implemented as part of a smartphone 1282, personal digital assistant, remote control, or other similar mobile device.

Various implementations of the systems and techniques described here can be realized in digital electronic circuitry, integrated circuitry, specially designed ASICs (application specific integrated circuits), computer hardware, firmware, software, and/or combinations thereof These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" "computer-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

As will be appreciated by one skilled in the art, the present disclosure may be embodied as a method, system, or computer program product. Accordingly, the present disclosure may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, the present disclosure may take the form of a computer program product on a computer-usable storage medium having computer-usable program code embodied in the medium.

Any suitable computer usable or computer readable medium may be utilized. The computer-usable or computer-readable medium may be, for example but not limited to, an electronic, magnetic, optical, electromagnetic, infrared, or semiconductor system, apparatus, device, or propagation medium. More specific examples (a non-exhaustive list) of the computer-readable medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a transmission media such as those supporting the Internet or an intranet, or a magnetic storage device. Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory. In the context of this document, a computer-usable or computer-readable medium may be any medium that can contain, store, communicate, propagate, or transport the program for use by or in connection with the instruction execution system, apparatus, or device.

Computer program code for carrying out operations of the present disclosure may be written in an object oriented programming language such as Java, Smalltalk, C++ or the like. However, the computer program code for carrying out operations of the present disclosure may also be written in conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through a local area network (LAN) or a wide area network (WAN), or the connection may be made to an external computer (for example, through the Internet using an Internet Service Provider).

The present disclosure is described below with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer-readable memory that can direct a computer or other programmable data processing apparatus to function in a particular manner, such that the instructions stored in the computer-readable memory produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the flowchart and/or block diagram block or blocks.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

The systems and techniques described here may be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network ("LAN"), a wide area network ("WAN"), and the Internet.

The computing system may include clients and servers. A client and server are generally remote from each other and typically interact through a communication network. The relationship of client and server arises by virtue of computer programs running on the respective computers and having a client-server relationship to each other.

The flowchart and block diagrams in the figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

Having thus described the disclosure of the present application in detail and by reference to embodiments thereof, it will be apparent that modifications and variations are possible without departing from the scope of the disclosure defined in the appended claims.

What is claimed is:

1. A computer-implemented method comprising:

receiving, via a plurality of microphone channels, a first audio signal, wherein the plurality of microphone channels include a primary channel and one or more secondary channels;

adapting one or more blocking filters on the plurality of microphone channels excluding the primary channel, wherein the one or more blocking filters are based upon, at least in part, a constraint vector, wherein the constraint vector preserves the first audio signal received by the primary channel;

generating, using the one or more blocking filters, one or more noise reference signals;

providing the one or more noise reference signals to an adaptive interference canceller to reduce a beamformer output power level; and simultaneously beamsteering and signal blocking, via the one or more blocking filters, based upon, at least in part, the one or more noise reference signals.

2. The computer-implemented method of claim 1, wherein a speech component of at least one of the one or more microphones is undistorted.

3. The computer-implemented method of claim 1, wherein the one or more blocking filters are configured to act as phase and amplitude alignment filters.

4. The computer-implemented method of claim 1, wherein the one or more microphones include differing channel amplitudes.

5. The computer-implemented method of claim 1, wherein the one or more blocking filters do not include a steering angle input.

6. The computer-implemented method of claim 1, wherein adapting includes one or more filter adaptation algorithms.

7. The computer-implemented method of claim 6, wherein the one or more filter adaptation algorithms includes a normalized least-mean squares algorithm.

8. The computer-implemented method of claim 1, wherein the one or more blocking filters uses the primary channel as an input to estimate a signal in at least one secondary channel of the one or more secondary channels.

9. The computer-implemented method of claim 1, wherein the one or more secondary signals include a plurality of secondary signals.

10. The computer-implemented method of claim 1, wherein the one or more blocking filters are based upon, at least in part, a blocking matrix configured to be orthogonal to the constraint vector.

11. A system comprising:

a plurality of microphones; and one or more processors configured to receive, via a plurality of microphone channels, a first audio signal, wherein the plurality of microphone channels include a primary channel and one or more secondary channels, the one or more processors configured to adapt one or more blocking filters on the plurality of microphone channels excluding the primary channel, wherein the one or more blocking filters are based upon, at least in part, a constraint vector, wherein the constraint vector preserves the first audio signal received by the primary channel, the one or more processors further configured to generate, using the one or more blocking filters, one or more noise reference signals, the one or more processors further configured to provide the one or more noise reference signals to an adaptive interference canceller to reduce a beamformer output power level, the one or more processors further configured to simultaneously beamsteer and signal block, via the one or more blocking filters, based upon, at least in part, the one or more noise reference signals.

12. The system of claim 11, wherein a speech component of at least one of the one or more microphones is undistorted.

13. The system of claim 11, wherein the one or more blocking filters are configured to act as phase and amplitude alignment filters.

14. The system of claim 11, wherein the one or more microphones include differing channel amplitudes.

15. The system of claim 11, wherein the one or more blocking filters do not include a steering angle input.

16. The system of claim 11, wherein adapting includes one or more filter adaptation algorithms.

17. The system of claim 16, wherein the one or more filter adaptation algorithms includes a normalized least-mean squares algorithm.

18. The system of claim 11, wherein the one or more blocking filters uses the primary channel as an input to estimate a signal in at least one secondary channel of the one or more secondary channels.

19. The system of claim 11, wherein the one or more secondary signals include a plurality of secondary signals.

20. The system of claim 11, wherein the one or more blocking filters are based upon, at least in part, a blocking matrix configured to be orthogonal to the constraint vector.

* * * * *